US005419398A

United States Patent [19]

Askestad

[11] Patent Number: 5,419,398

[45] Date of Patent: May 30, 1995

[54] DRIVE SYSTEM FOR TURNING A SWIVEL

[75] Inventor: Sigmund Askestad, Saetre, Norway

[73] Assignee: Norsk Hydro a.s., Oslo, Norway

[21] Appl. No.: 204,290

[22] PCT Filed: Jul. 2, 1993

[86] PCT No.: PCT/NO93/00107

§ 371 Date: Mar. 10, 1994

§ 102(e) Date: Mar. 10, 1994

[87] PCT Pub. No.: WO94/01655

PCT Pub. Date: Jan. 20, 1994

[30] Foreign Application Priority Data

Jul. 10, 1992 [NO] Norway ..... 922724

[51] Int. Cl.[6] ..... E21B 7/132; B63B 35/44

[52] U.S. Cl. ..... 166/355; 166/358; 166/365; 175/7

[58] Field of Search ..... 166/351, 352, 355, 358, 166/365; 175/7, 8, 10

[56] References Cited

U.S. PATENT DOCUMENTS

| | | | |
|---|---|---|---|
| 712,002 | 10/1902 | Packard | 175/10 X |
| 972,192 | 10/1910 | Hoff | 175/10 |
| 3,602,175 | 8/1971 | Morgan et al. | 175/7 X |
| 3,857,450 | 12/1974 | Guier | 175/207 X |
| 4,200,054 | 4/1980 | Elliston | 166/355 X |
| 4,436,451 | 3/1984 | Anderson | 166/355 X |
| 4,557,332 | 12/1985 | Denison et al. | 166/355 X |
| 4,617,998 | 10/1986 | Langner | 166/355 X |
| 4,694,909 | 9/1987 | Stephenson et al. | 166/359 |
| 4,841,895 | 6/1989 | Brewerton | 166/355 X |

*Primary Examiner*—Roger J. Schoeppel
*Attorney, Agent, or Firm*—Wenderoth, Lind & Ponack

[57] ABSTRACT

A system for turning a swivel aboard a vessel for oil extraction at sea includes a stationary swivel part connected to a rotary drilling rig on the vessel and one or more rotating parts connected to the vessel. The rotating swivel parts are connected to a torsionally rigid vertical frame structure via a drive mechanism which transmits rotary motion between the vessel and the swivel without angular displacement or significant reactive forces in the frame structure. The vertical frame structure includes four walls where one of the walls forms a gate for the insertion and removal of an entire swivel or parts of a swivel. The frame structure is attached to an overhead frame that extends across the diameter of the rotary drilling rig and is secured to the hull of the vessel.

20 Claims, 4 Drawing Sheets

DRIVE SYSTEM FOR TURNING A SWIVEL

BACKGROUND OF THE INVENTION

The present invention relates to a system for turning a swivel that forms a rotating connection between one or more risers and a piping system on a production vessel, a platform or the like for the production of oil or gas, and including a stationary part connected with a rotary drilling rig or the like on the vessel and one or more parts pivotally mounted in relation to the stationary part and connected to the vessel.

Systems for turning such a swivel aboard a production vessel for oil extraction at sea are known, but are of relatively small dimensions and weights, and have low operating pressures. Such a conventional system is furnished with a single drive arm attached to a lower part of the swivel and controlling rotary motion between the stationary part and the lower, rotating part of the swivel and transmits motion to other parts of the swivel by means of shear stress connections. Such system works well at relatively low production pressures and fluid volumes, in calm waters and at shallow to medium sea depths, but has disadvantages at high production pressures, high fluid volumes and in turbulent waters. In such conditions the swivel weight may be 100–150 tonnes and operational safety requirements are very high. For such large, heavy swivel systems the conventional turning systems are not suitable because the dimensions of the drive arm and the shear stress connections are very large and interfere with other equipment on the rotary drilling rig.

SUMMARY OF THE INVENTION

One object of the present invention is to provide a system for turning heavy swivels aboard oil extraction vessels at sea, such that even at high production pressures in turbulent waters, the handling risks involved in replacing such a swivel will be substantially reduced. A further object is to obtain stable, direct transmission of rotary motion of the vessel ("yawing" movements) to the various rotating parts of such a swivel in order to reduce the load on rigid pipe connections between the swivel parts and the frame, but at the same time to retain flexibility with respect to relative movements in the x and y axes. A still further object is to provide a drive solution which will permit sideways replacement of a swivel without affecting rotational stability during normal operations.

In accordance with the invention, a solution has been devised wherein the rotating part or parts of the swivel are connected to a frame structure via a drive mechanism, the frame structure being fixed to a rigid overhead frame which extends over the rotary drilling rig and is fixed to the vessel.

BRIEF DESCRIPTION OF THE DRAWINGS

The following will describe an embodiment of the invention with reference to the drawings, in which.

DETAILED DESCRIPTION OF THE INVENTION

Figure 1:
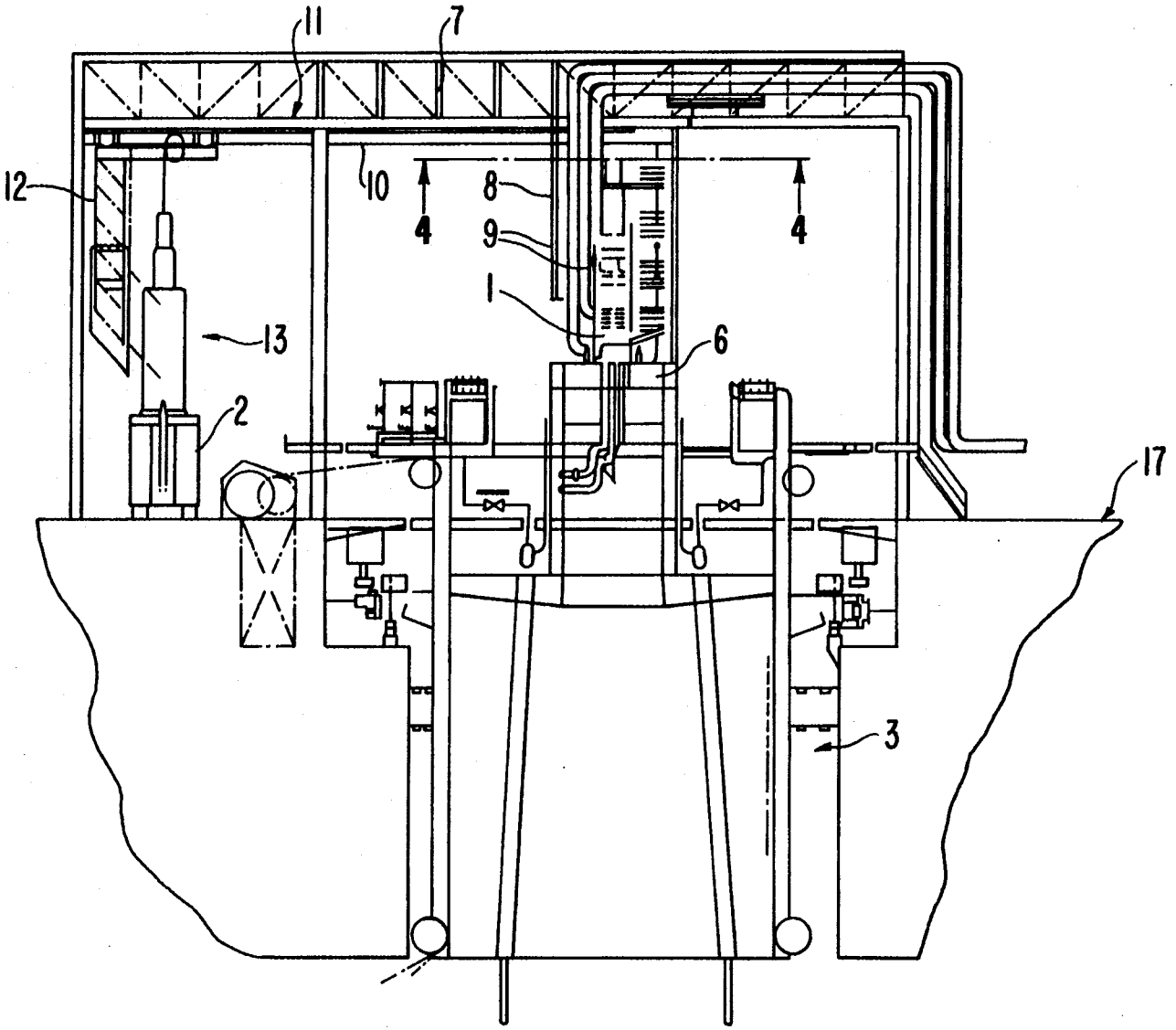
FIG. 1 (PRIOR ART)
FIG. 1 is an elevation view of part of a ship with a rotary drilling rig with an overhead frame and frame structure in accordance with the invention.

FIG. 1 shows a rotary drilling rig 3 in a hull 17 of a production vessel, and a lifting device 12 for removing a swivel 1 which normally stands on a base 6 of the rotary drilling rig 3, or for placing a spare swivel 13 on the base 6. The swivel lifting device 12 runs on rails 10 which are mounted on the underside 11 of an overhead frame 7 such that the swivel lifting device 12 can move between a first position at the center of the rotary drilling rig 3 and a second position at the backup swivel 13, which is stored on a base 2 outside the rotary drilling rig. This solution is shown and described in more detail in the Norwegian Patent No. 175,012 and will not be described in more detail here.

The overhead 7 is three-dimensional and includes a horizontal lattice framework which is rigidly fixed to the hull of the vessel and spans across and above the rotary drilling rig 3. Overhead frame 7, and a frame structure 8, which is attached to the frame 7, constitute a drive structure of the invention. The frame structure 8 is vertical, and is built with substantial strength and torsional rigidity such that it can transmit torsional forces without angular displacement between a pipe coupling 9 and the overhead frame 7.

Figure 3:
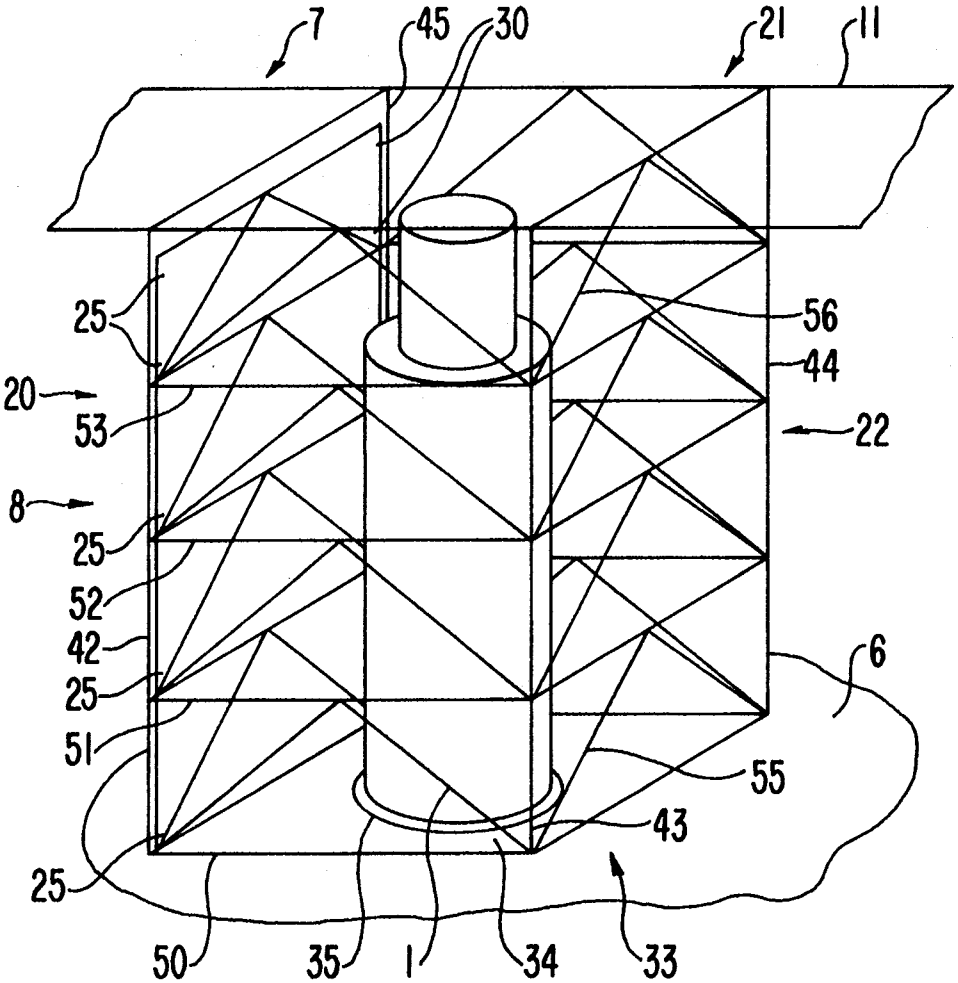
FIG. 3 is a perspective view of the construction of the frame structure with the placement of the swivel therein.
Figure 2:
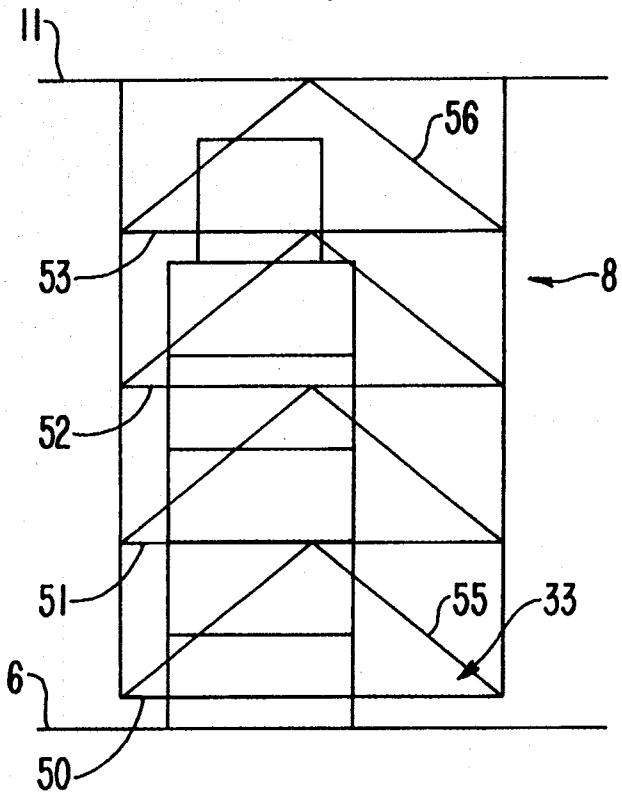
FIG. 2 is a diagram representing the principle of the arrangement of the frame structure in relation to the arrangement of various rotating parts of a swivel.

FIG. 2 shows, on a larger scale, the frame structure 8 and the placing relative thereto of the individual parts of the swivel. FIG. 3 further shows the frame structure 8 in perspective. It has four walls 20, 21, 22, 23 and a bottom 33, and at its upper part is rigidly connected with the frame 7. Frame structure 8 surrounds the swivel 1 and extends towards the base 6 on the rotary drilling rig 3. Three of the walls of frame structure 8 are built as two-dimensional latticework formed of vertical pipes or chords 42, 43, 44, 45, horizontal stays 50, 51, 52, 53 and diagonal stays 55, 56. The bottom 33 includes a frame 34 with a center aperture 35 for the swivel 1 which is mounted on the base 6. There is a clearance between the bottom 33 and the swivel base 6 and swivel 1, such that the drive structure can rotate freely in relation to the swivel base.

Figure 4:
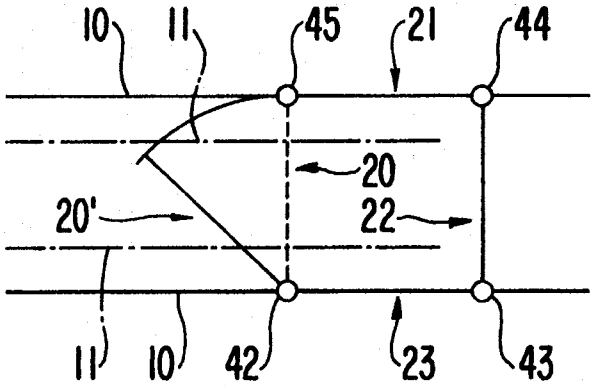
FIG. 4 is a section along line 4—4 of FIG. 1 of the frame structure at a lower edge of the overhead frame.

The fourth wall (20 in FIG. 4) includes a gate 20′ built as a planar frame. Hinges and locks connect important structure elements in the gate 20′ and the frame structure 8. FIG. 4 is a section along line 4—4 in FIG. 1 of the frame structure 8 beneath the overhead frame 7 and shows a craneway with the rails 10 for the swivel lifting device 12 which can be moved into the center of frame structure 8 such that the swivel can be taken in and out of the frame structure 8 through the gate 20′.

Figure 5:
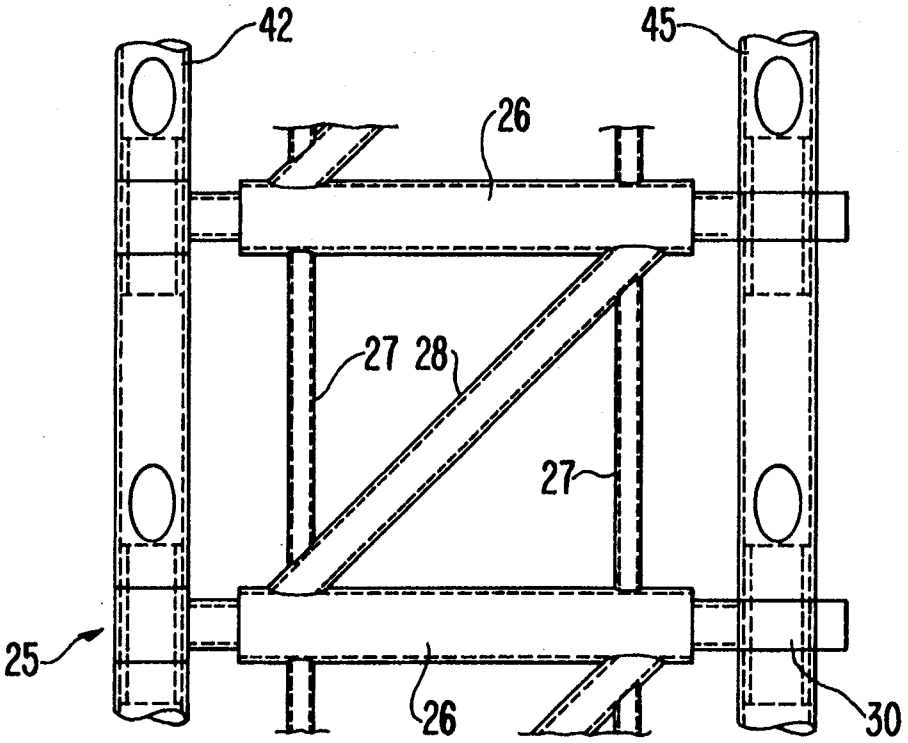
FIG. 5 is an enlarged view of a gate in the frame structure shown in a closed state.

FIG. 5 shows a portion of the gate 20′ which constitutes an independent planar frame with horizontal stays 26, vertical stays 27 and diagonal stays 28. The gate 20′ forms a side of the frame structure 8 when it is closed during operation, and can be swung out to the side (FIG. 4) to create free access of the swivel lifting device 12 to the swivel 1. The horizontal stays 26 are firmly connected at first ends thereof to outer pipe elements 25 which are rotatably provided on and thereby hinged to the pipe 42. At the other, opposite ends of the stays 26 are designed to be locked to the pipe 45 when the gate 20' is in closed position. Such locks may for instance be in the form of retractable extensions 30 (retractable within the stays 26) extending through corresponding holes in the pipe 45. The advantage of the lock 30 and the hinge 25 is that they also function as structural elements, and that they mainly take the form of standard pipe junctions with known strength characteristics.

Figure 6:
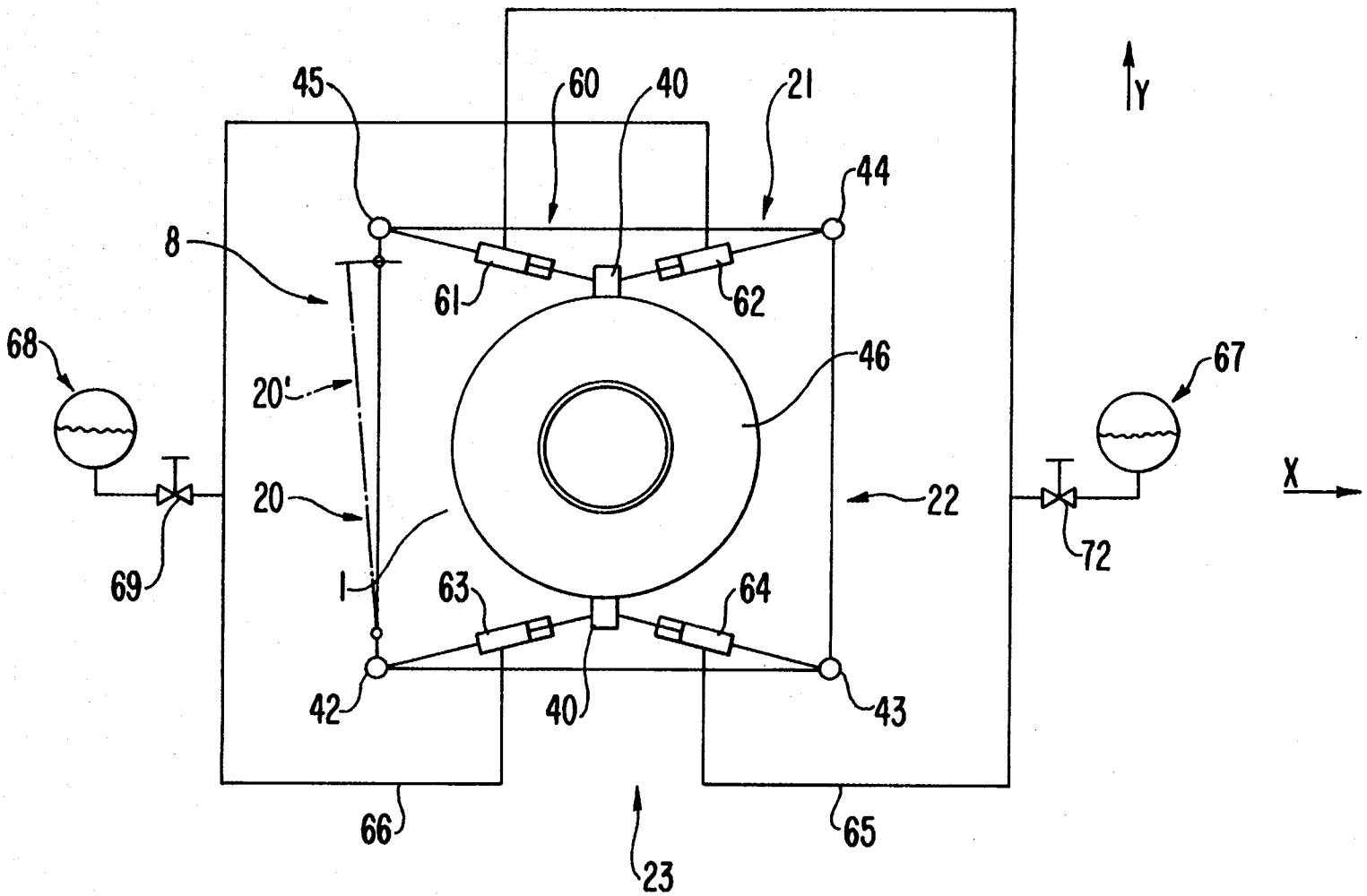
FIG. 6 is a schematic view of a drive mechanism and connection between an outer, rotating part of the swivel and the frame structure.

FIG. 6 shows a drive mechanism 60 that includes four hydraulic cylinders 61, 62, 63 and 64 which are secured by pins 40 on an outer ring 46 of the swivel, or on each of the outer rings of the swivel where the swivel consists of several swivel parts, in the drive frame 8. Hydraulic pipe 65 connects cylinders 61 and 64 in one system. Hydraulic pipe 66 connects cylinders 62 and 63 in one system. Filling valves 69, 72 are located in respective pipes 66 and 65. Accumulator containers 67, 68 are coupled through respective valves 72, 69 with respective pipes 65, 66. The drive system is designed to transmit rotary motion of the frame structure 8 to the outer ring 46 of the swivel, but at the same time to permit changes in the lateral position of the swivel 1 in relation to the frame structure 8.

More precisely, the response of the hydraulic system to relative movements between the frame structure 8 and the swivel 1 will be as follows. A movement of the swivel along the x axis will cause the hydraulic fluid in the cylinders 64 and 62 to be pressed out into the piping systems 65 and 66, respectively. At the same time, hydraulic fluid will be drawn in on the opposite side into the cylinders 61 and 63, respectively, in corresponding amounts, so there will be no resistance to this motion. In the event of torsion on the frame structure 8 when the vessel turns, on the other hand, there will be resistance, because hydraulic fluid from the cylinders 62 and 64 will be pressed through the piping systems 66 and 65 respectively against corresponding pressure in the cylinders 63 and 61 respectively. In the first case, in the event of motion in the x of y axis, the two pairwise mounted cylinder arrangements will thus be in phase (pressure against suction) such that there will be no resistance to movement. However, in the second case, i.e. rotation, the two cylinders will be in phase opposition (pressure against pressure) and there will be no relative movement between the frame structure 8 and the swivel.

It should be noted that the invention is not restricted to the specific above arrangement. Thus, instead of piston/cylinder devices, shock-absorber/spring devices could be used, in which case however there would be a certain amount of angular movement between the frame structure 8 and the swivel 1 when the latter is rotated.

I claim:

1. In a production vessel for oil extraction at sea and including a rotary drilling rig and a swivel having a stationary part connected to said rotary drilling rig and at least one rotating part mounted on said vessel for rotation relative to said stationary part, the improvement comprising:

a rigid overhead frame secured to said vessel and extending over said rotary drilling rig;

a frame structure attached to said overhead frame; and a drive mechanism connected to said frame structure and to said at least one rotating part of said swivel, thereby enabling turning of said at least one rotating part of said swivel relative to said stationary part thereof.

2. The improvement claimed in claim 1, wherein said drive mechanism comprises at least one hydraulic piston-cylinder device having a first end connected to said frame structure and a second end connected to said at least one rotating part.

3. The improvement claimed in claim 2, comprising plural piston-cylinder devices.

4. The improvement claimed in claim 2, comprising at least two pairs of piston-cylinder devices, said pairs being connected in parallel.

5. The improvement claimed in claim 4, wherein said devices of each said pair are connected by a hydraulic system including a pipe connected to said devices, and an accumulator connected to said pipe by a valve.

6. The improvement claimed in claim 1, wherein said drive mechanism comprises at least one spring-shock absorber device having a first end connected to said frame structure and a second end connected to said at least one rotating part.

7. The improvement claimed in claim 6, comprising plural spring-shock absorber devices.

8. The improvement claimed in claim 6, comprising at least two pairs of spring-shock absorber devices, said pairs being connected in parallel.

9. The improvement claimed in claim 1, wherein said frame structure comprises a latticework structure having four sides and a bottom surrounding said swivel, said bottom being spaced from a swivel base and having an opening.

10. The improvement claimed in claim 9, wherein one said side comprises a gate that is openable to allow passage therethrough of the swivel and that is closable to define a rigid frame structure.

11. A system to be employed in a production vessel for oil extraction at sea and including a rotary drilling rig and a swivel having a stationary part connected to the rotary drilling rig and at least one rotating part mounted on the vessel for rotation relative to the stationary part, said system comprising:

a rigid overhead frame to be secured to the vessel to extend over the rotary drilling rig;

a frame structure attached to said overhead frame; and a drive mechanism connected to said frame structure and to be connected to the at least one rotating part of the swivel, thereby enabling turning of the at least one rotating part of the swivel relative to the stationary part thereof.

12. A system as claimed in claim 11, wherein said drive mechanism comprises at least one hydraulic piston-cylinder device having a first end connected to said frame structure and a second end to be connected to the at least one rotating part.

13. A system as claimed in claim 12, comprising plural piston-cylinder devices.

14. A system as claimed in claim 12, comprising at least two pairs of piston-cylinder devices, said pairs being connected in parallel.

15. A system as claimed in claim 14, wherein said devices of each said pair are connected by a hydraulic system including a pipe connected to said devices, and an accumulator connected to said pipe by a valve.

16. A system as claimed in claim 11, wherein said drive mechanism comprises at least one spring-shock absorber device having a first end connected to said frame structure and a second end to be connected to the at least one rotating part.

17. A system as claimed in claim 16, comprising plural spring-shock absorber devices.

18. A system as claimed in claim 16, comprising at least two pairs of spring-shock absorber devices, said pairs being connected in parallel.

19. A system as claimed in claim 11, wherein said frame structure comprises a latticework structure having four sides and a bottom to surround the swivel, said bottom to be spaced from a swivel base and having an opening.

20. A system as claimed in claim 19, wherein one said side comprises a gate that is openable to allow passage therethrough of the swivel and that is closable to define a rigid frame structure.

* * * * *